US005099866A

United States Patent [19]

Solis et al.

[11] Patent Number: 5,099,866

[45] Date of Patent: Mar. 31, 1992

[54] PROTECTIVE PLAY ENCLOSURE

[76] Inventors: Clorinda A. Solis; Jaime J. Solis, both of 3442 Larson Dr., Omaha, Nebr. 68123

[21] Appl. No.: 342,995

[22] Filed: Apr. 24, 1989

[51] Int. Cl.[5] ..... E04H 15/42

[52] U.S. Cl. ..... 135/105; 135/109; 135/117

[58] Field of Search ..... 135/101, 105, 106, 109, 135/110, 117; 5/99 C, 99 R, 99 B, 99 A

[56] References Cited

U.S. PATENT DOCUMENTS

| | | | |
|---|---|---|---|
| 324,128 | 8/1885 | Lindblom . | |
| 434,767 | 1/1985 | Watts | 5/99 |
| 487,319 | 12/1892 | Davis . | |
| 654,972 | 7/1900 | Haack . | |
| 804,581 | 11/1905 | Carmichael . | |
| 925,059 | 6/1909 | Walker | 135/109 |
| 1,045,132 | 11/1912 | Dorsey . | |
| 1,113,647 | 10/1914 | Jones . | |
| 1,147,414 | 7/1915 | Lera . | |
| 1,321,905 | 11/1919 | Gannon . | |
| 1,433,457 | 10/1922 | Hunter . | |
| 1,546,698 | 7/1925 | Zoll et al. | 52/109 X |
| 1,650,323 | 11/1927 | Byars . | |
| 1,728,356 | 9/1929 | Morgan | 135/109 |
| 1,856,658 | 3/1932 | Rummler . | |
| 1,940,147 | 12/1933 | Sankus . | |
| 2,065,225 | 12/1936 | Kennedy | 135/109 |
| 2,120,861 | 6/1938 | Hastings . | |
| 2,570,446 | 10/1951 | Hoffman | 5/99 C |
| 2,672,627 | 3/1954 | Hagelfeldt . | |
| 2,681,659 | 6/1954 | Hrinsin | 5/99 C |
| 3,028,871 | 4/1962 | Cliff | 135/109 |
| 3,146,736 | 9/1964 | Hetrick . | |
| 3,165,760 | 1/1965 | Abajian . | |
| 3,540,458 | 11/1970 | Osterhoudt | 135/4 |
| 3,943,953 | 3/1976 | Cantwell et al. | 135/3 E |
| 4,066,089 | 1/1978 | Rainwater | 135/3 E |
| 4,072,158 | 2/1978 | O'Brien et al. | 135/1 R |
| 4,202,065 | 5/1980 | Sullivan | 5/99 |
| 4,494,558 | 1/1985 | Fidler, Jr. | 135/102 |
| 4,683,600 | 8/1987 | Beger | 5/99 C |
| 4,692,953 | 9/1987 | Fetters | 5/99 |
| 5,025,821 | 6/1991 | Page et al. | 135/109 X |

FOREIGN PATENT DOCUMENTS

| | | | |
|---|---|---|---|
| 562430 | 5/1957 | Italy | 135/109 |

*Primary Examiner*—David A. Scherbel
*Assistant Examiner*—Lan Mai
*Attorney, Agent, or Firm*—John A. Beehner

[57] ABSTRACT

A protective play enclosure includes a frame having first and second rectangular frame members which are inclined relative to one another with end braces arranged in an X-configuration. A flexible floor extends between the bottom frame crossbars and a flexible wall of a netting material extends upwardly from the floor and is connecting to the frame top cross bars. The frame end braces are extendable and retractable for erecting and collapsing the enclosure. A frame top for the enclosure can be pivotally displaced to a position along one sidewall when an open topped enclosure is preferred.

20 Claims, 8 Drawing Sheets

PROTECTIVE PLAY ENCLOSURE

BACKGROUND OF THE INVENTION

The present invention is directed generally to a protective play enclosure for children and more particularly to a lightweight readily collapsible enclosure having a displaceable top for use of the enclosure with the top opened or closed.

Many types of child playpens are known and commercially available ranging from the old wooden playpens with vertical bars in the wall to the more modern metal framed playpens having a raised floor surface and walls of a netting fabric. Several problems associated with these known playpens are the lack of a top covering to shield a child from the sun and to prevent the child from climbing out from the top of the playpen, and the heavy weight due in part to the raised solid floor panels of the playpen. Another problem with known playpens is that they afford little blockage of sun for napping and have sidewalls which do not shield a child from blowing dirt, sand, insects and other debris.

Accordingly, a primary object of the invention is to provide an improved protective play enclosure for children.

Another object is to provide such an enclosure with a removable top for covering the enclosure at times.

Another object is to provide such an enclosure which is very lightweight and readily collapsible for storage and transport.

Another object is to provide such an enclosure with a fabric floor and walls so constructed to prevent the entry of insects or flying debris into the enclosure.

Another object is to provide such an enclosure with displaceable wall panels across the enclosure sidewalls for blocking the sun and visibility into and from the enclosure.

Another object is to provide such an enclosure which is simple and rugged in construction, economical to manufacture and efficient in operation.

SUMMARY OF THE INVENTION

The protective play enclosure of the invention includes a frame including first and second generally rectangular frame members which are inclined relative to one another with the end braces arranged in an X-configuration. A flexible fabric floor is connected to and extends between the bottom frame crossbars and a flexible wall extends upwardly from the edges of the floor and is connected to the frame top crossbars. The frame end braces are extendable and retractable between a collapsed length no longer than the width of the floor and an extended length longer than the width of the floor thereby to support the sidewalls in upright relation when the end braces are extended. The flexible wall is preferably made of fine netting to allow passage of sun and air while screening out insects, dirt, debris and the like.

A top is displaceably connected to an upper portion of the enclosure so as to be adjustable between an operative position over the top of the enclosure and an inoperative position adjacent one sidewall. The top includes a frame for generally arched support above the end walls and further includes netting for closing the openings between the top and end walls. Displaceable flaps cover the flexible wall surfaces for shading selected surfaces or darkening the enclosure for nap time, for example. The entire enclosure can be collapsed flat into a light weight compact package for convenient transport and storage.

BRIEF DESCRIPTION OF THE DRAWINGS

FIG. 12 B is a partial detailed side view of the pivotal braces of the enclosure.

DESCRIPTION OF THE PREFERRED EMBODIMENT

Figure 1:
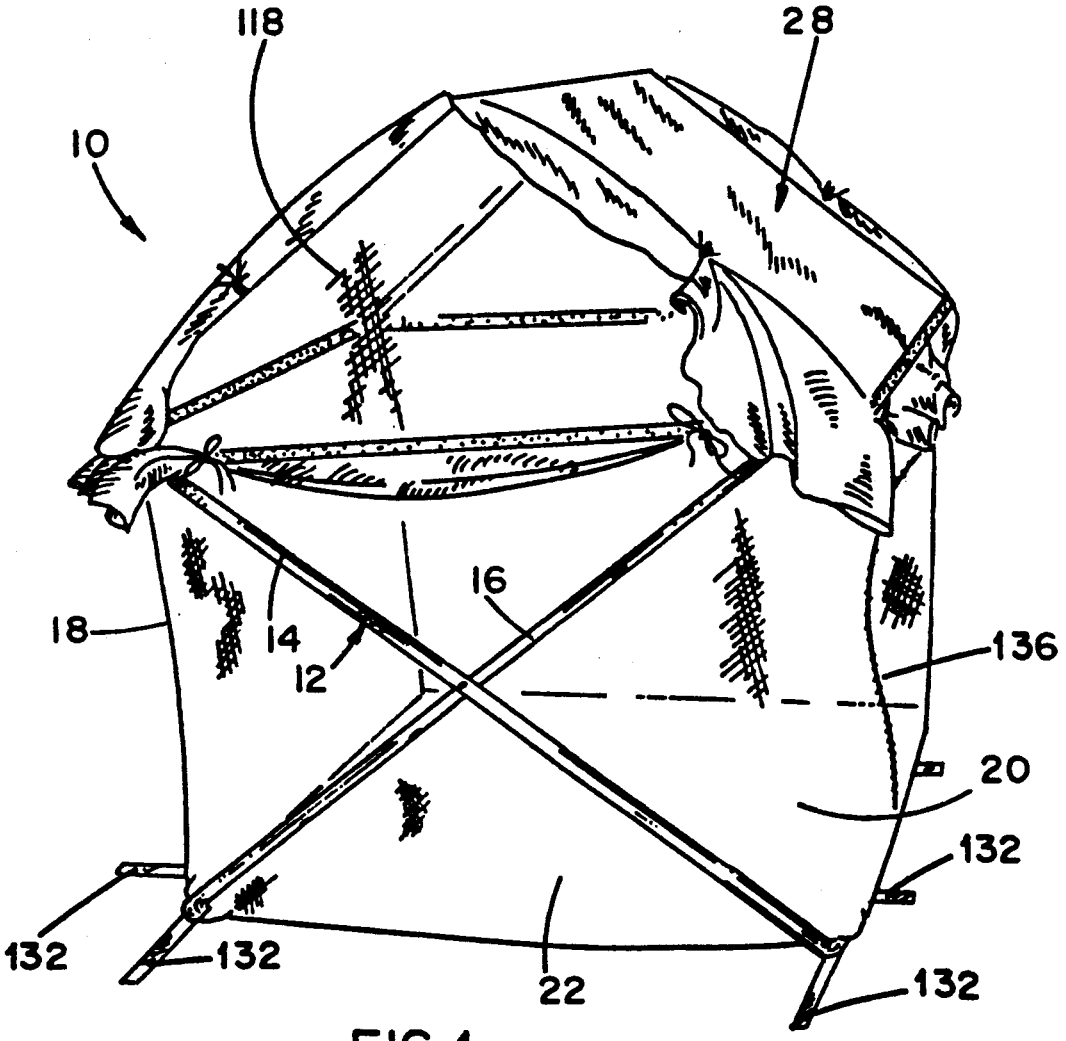
FIG. 1 is a perspective view of the protective play enclosure of the invention.

The protective play enclosure 10 of the present invention has a frame 12 which includes first and second generally rectangular frame members 14 and 16 which are crossed at opposite ends for supporting an open topped fabric playpen including two sidewalls 18 and 20, two end walls 22 and 24 and a flexible fabric floor 26. A framed flexible top 28 is pivotally connected at the top of one sidewall and releaseably secured to the top of the opposite sidewall so that the top can be collapsed and displaced to a position overlying one sidewall when an open top for the enclosure is preferred.

Figure 2:
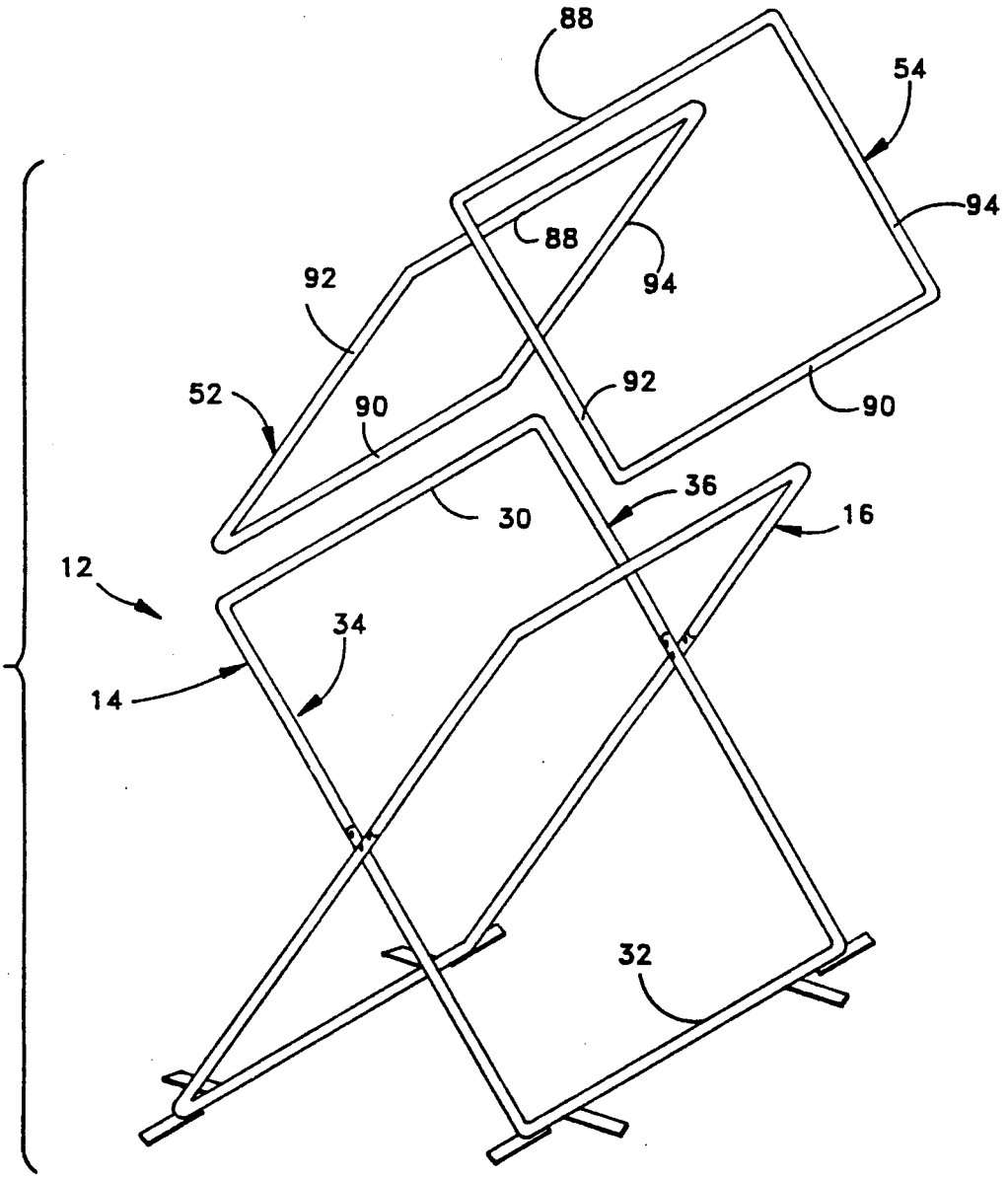
FIG. 2 is a perspective view of the frame of the enclosure.
Figure 3:
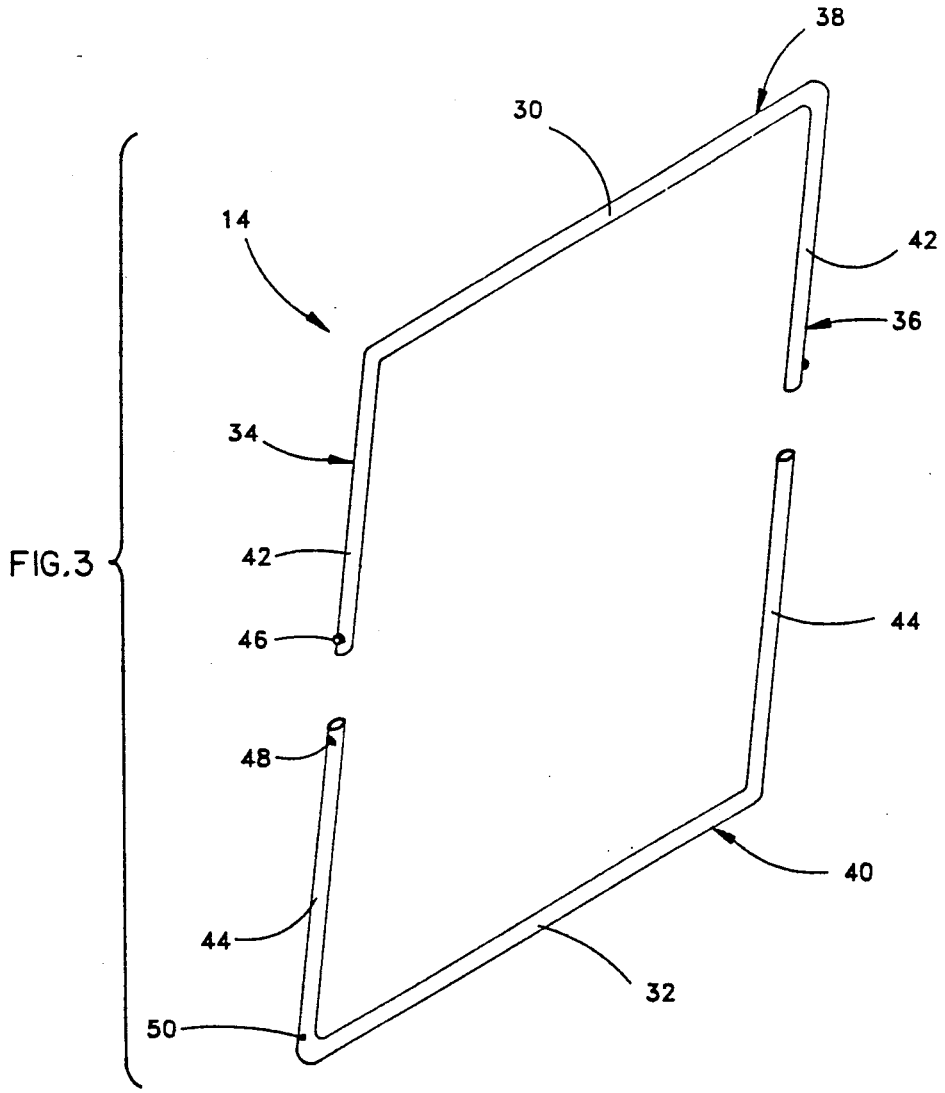
FIG. 3 is a detailed view of the one rectangular frame member.
Figure 4:
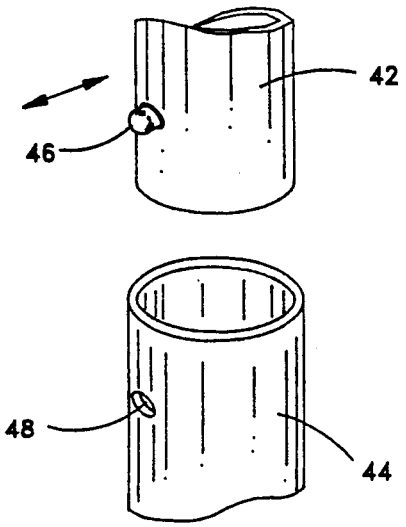
FIG. 4 is a partial enlarged view showing the spring-pin fastener for securing the frame end brace in the extended position thereof.

Frame 12 is illustrated in FIG. 2 as including the first frame member 14 which comprises top and bottom crossbars 30 and 32 and a pair of end braces 34 and 36 which are extendable and retractable and connected to and extended between top and bottom crossbars 30 and 32. In the preferred embodiment, the first frame member 14 includes a pair of U-shaped frame sections 38 and 40 (FIG. 3) each of which includes one of the crossbars 30 or 32 and legs comprising telescoping portions of the end braces 34 and 36. The upper U-shaped frame section 38 is formed of smaller diameter tubing than the lower U-shaped frame section 40 for telescopic receipt of the upper legs 42 within the lower legs 44. Each upper leg 42 has an outwardly directed spring finger 46 adjacent the lower end thereof, which finger is biased outwardly of the tube but may be manually depressed into the tube to permit telescoping movement within lower tube 44. Lower tube 44 has upper and lower holes 48 and 50 for receiving the spring finger 46 and establishing the extended and collapsed conditions respectively for the first frame member 14.

The second frame member 16 is identical to the first frame member 14, except that the top and bottom crossbars 30 and 32 of second frame member 16 are slightly lengthened to accommodate receipt of the first frame member therein as shown in FIG. 2 without bending of the end braces 34 and 36 of either frame member. The added length is preferably equal to twice the outer diameter of lower leg 44 of first frame member 14. Accordingly, the same reference numerals will be used to refer to like parts of each frame member.

Top 28 also includes a frame which, in the preferred embodiment shown in FIG. 2, includes a pair of rectangular frames 52 and 54 which are pivotally secured together and pivotally secured to the top crossbar 30 of first frame member 14 by the fabric of the top 28 as described herein below.

Figure 7:
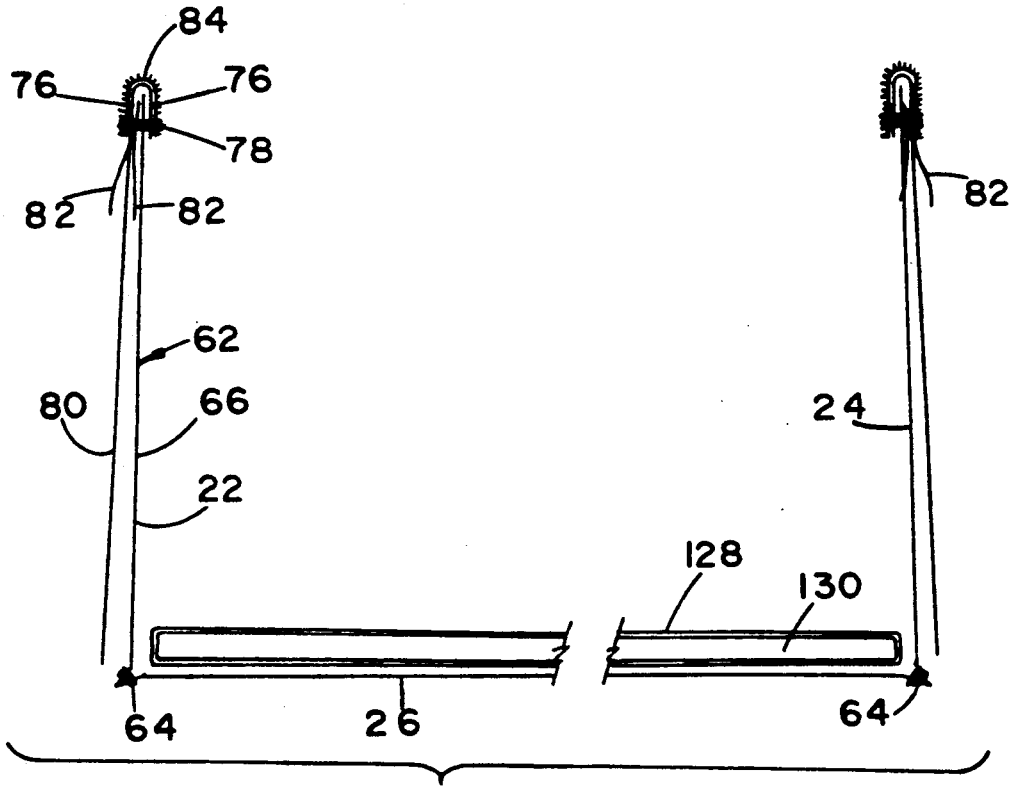
FIG. 7 is a foreshortened longitudinal sectional view through both end walls of the enclosure.
Figure 11:
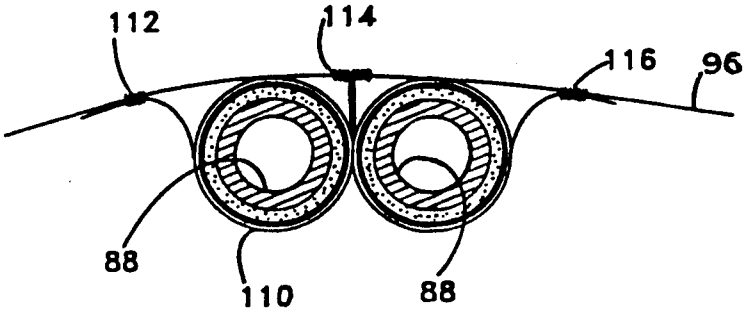
FIG. 11 is a detail partial sectional view through the peak of the enclosure top.
Figure 10:
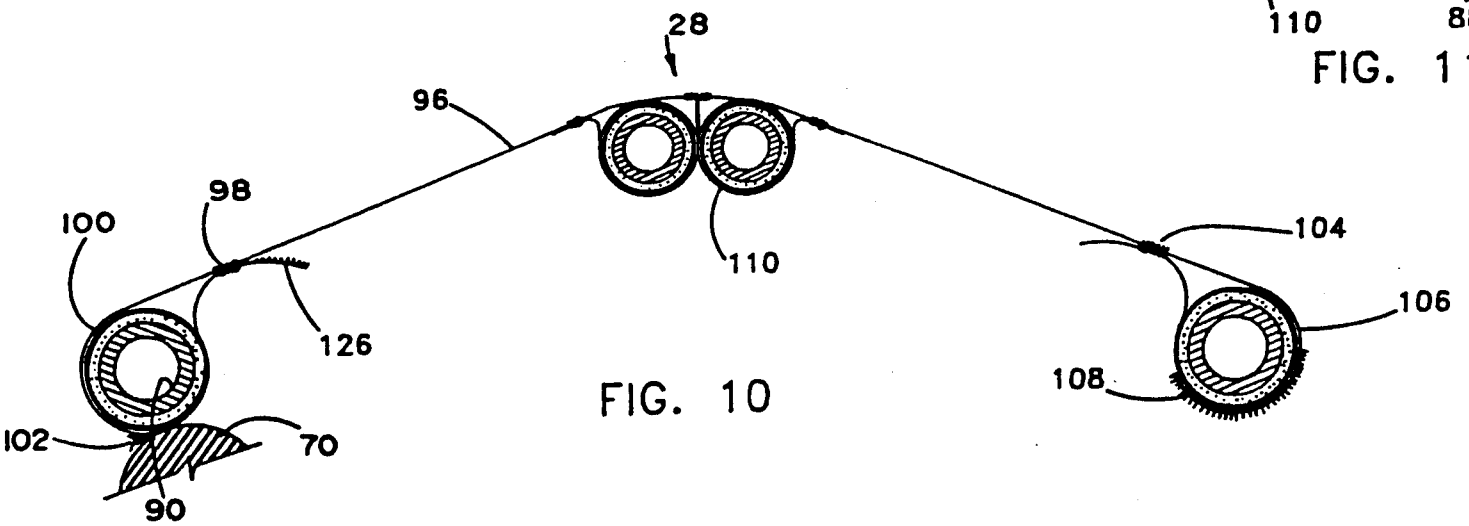
FIG. 10 is a partial transverse sectional view through the top of the enclosure.

The dimensions of the erected enclosure are defined by the fabric covering which includes a generally rectangular flexible fabric floor 26. Floor 26 has identical opposite side edges 58 (FIG. 5) which are folded and stitched, at 60, to define a sleeve for receiving the bottom crossbar 32 of a respective frame member 14 or 16. That same stitching 60 affords a continuous connection along the length of side edge 58 to the bottom edge of the upright flexible wall 62 of the enclosure. FIG. 7 illustrates that the end edges 64 of floor 66 are likewise stitched to end wall portions 66 of flexible wall 62.

The floor 56 is preferably formed of a nylon fabric for strength and resistance to tearing. Since the side edges 58 of floor 56 are connected to the bottom crossbar 32 the width of the floor 56 is substantially the width of the erected enclosure 10.

The flexible wall 62 is preferably formed of a durable netting fine enough to keep out insects, yet sturdy enough to withstand repeated contact by an active child. Whereas a tent screening material could be used, a softer nylon netting with somewhat larger openings is preferred.

Figure 5:
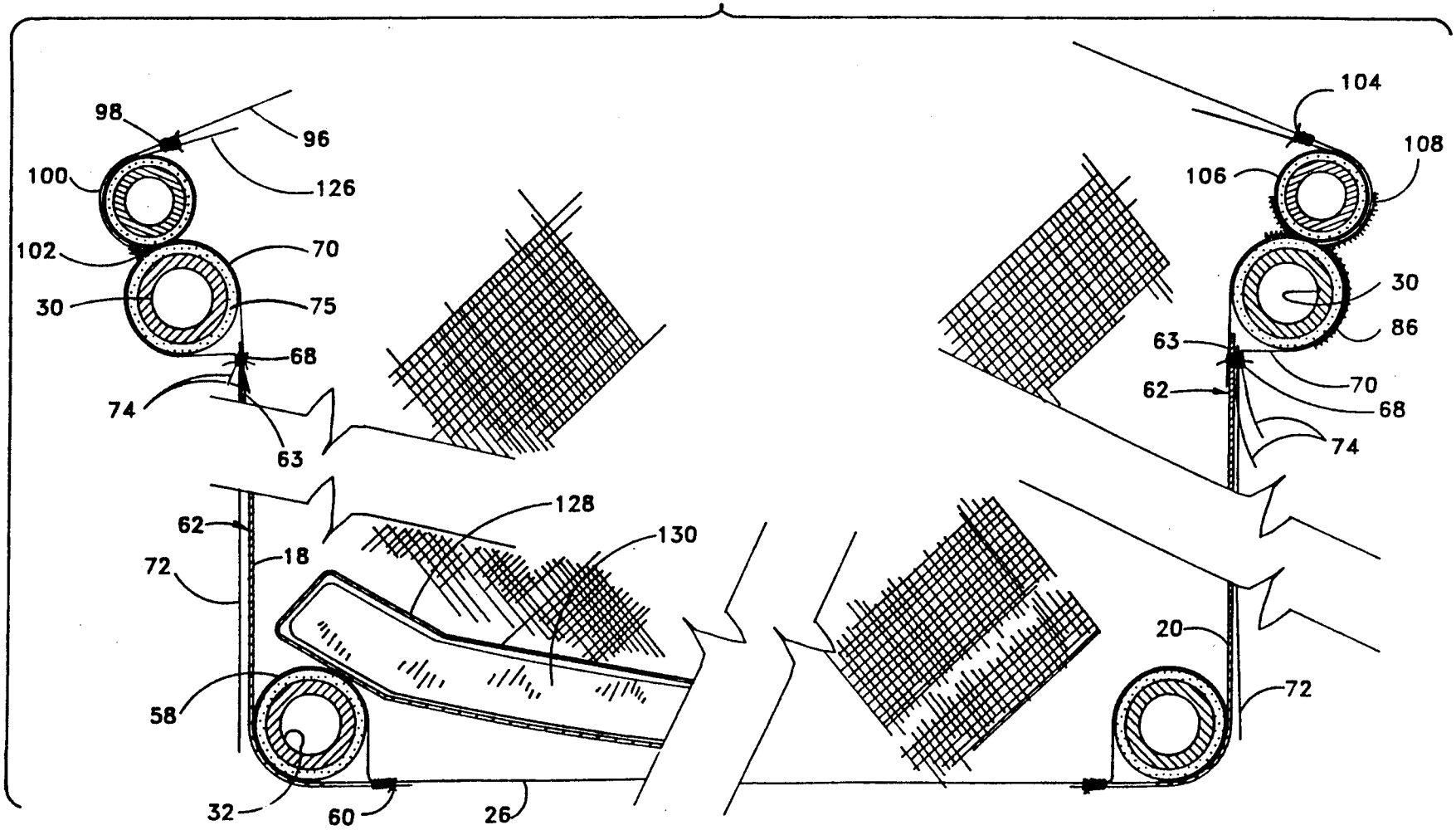
FIG. 5 is a partial transverse sectional view through both sidewalls of the enclosure.
Figure 6:
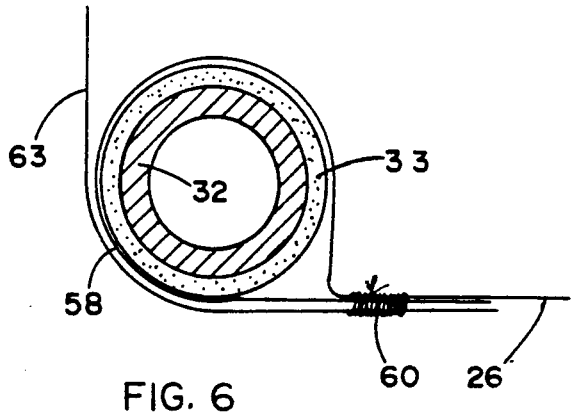
FIG. 6 is a detailed partial sectional view of one bottom corner of the enclosure as seen in FIG. 5.

Referring to FIG. 5, the upper edge of each sidewall portion 63 is sewn by stitching 68 to a fabric sleeve 70 which is preferably integrally formed with a side flap 72 which drapes downwardly to substantially cover sidewall portion 63 of netting 62. A tie-string 74 is also secured by stitching 68 for temporarily securing the rolled up side flap 72 in an elevated position adjacent fabric sleeve 70 when it is preferred to leave sidewall portion 63 uncovered.

Because the end braces 34 and 36 of the first and second frame member 14 and 16 are crossed, the top crossbar 30 of first frame member 14 (FIGS. 1 and 5) is connected to the same sidewall portion 63 that is connected to the bottom crossbar 32 of the second frame member 16. Likewise, the top crossbar 30 of the second frame member 16 is connected to the same sidewall portion 63 that is connected to the bottom crossbar 32 of the first frame member 14.

Figure 9:
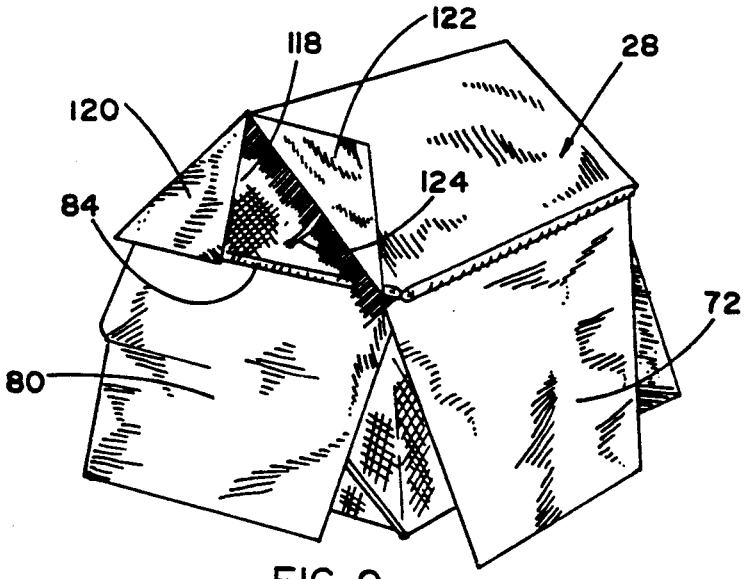
FIG. 9 is a perspective view of the enclosure with the top wall in place and the fabric flaps lowered.

Referring to FIG. 7, upper edge of end wall portion 66 of netting 62 is sewn to a fabric rim 76 by stitching at 78, which rim is preferably integrally formed with an end flap 80 which drapes downwardly to substantially cover end wall portion 66. A tie-string 82 is likewise secured by stitching 78 to temporarily secure the rolled up end flap 80 adjacent rim 76 when it is desired that end wall portion 66 be uncovered. A strip 84 of a hook and loop-type fastener fabric such as Velcro is likewise secured over a substantial central portion of the length of fabric rim 76 as shown in FIG. 9 for detachable connection to the bottom edge of a netting end wall portion of top 28, as described hereinbelow. Referring to FIG. 5, a similar strip of Velcro-like fabric 86 is sewn or otherwise secured onto the top outer portion of fabric sleeve 70 along the top of one sidewall portion 63 for a detachable connection to the free end of top 28 as described below.

Figure 8:
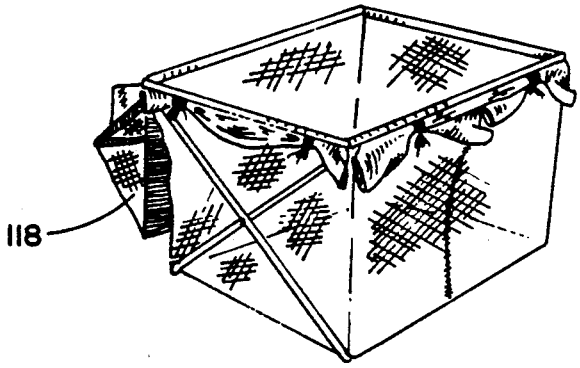
FIG. 8 is a perspective view of the enclosure with the top displaced.

The height of flexible netting 62 is such that it is substantially stretched taut upon extension of the frame member end braces 34 and 36 to their extended conditions shown in FIGS. 1 and 8. Fabric rims 76 on the upper edges of end wall portions 66 and fabric sleeves 70 on the upper edges of sidewall portions 63 are substantially nonstretchable and, therefore, constitute a continuous upper periphery which prevents vertical collapsing of the enclosure upon extension of the end braces 34 and 36 to their extended condition. This is because the spacing between the tops of the end braces 34 is fixed by the length of fabric rims 76 and the spacing between the lower ends of the end braces is fixed by the width of the floor 26.

The structure of top 28 is shown is FIGS. 2, 5, 9, 10 and 11. Referring first to FIG. 2, the rectangular frames 52 and 54 shall be referred to as the secured frame and free frame, respectively, each including a top crossbar 88, bottom crossbar 90 and opposite end braces 92 and 94. The fabric covering 96 over top 28 has one side edge folded back and stitched at 98 to define a sleeve 100 through which the bottom crossbar 90 of secured frame 52 extends. That sleeve 100 is stitched at 102 (FIG. 5) continuously along the length thereof to the fabric sleeve 70 along the top of one sidewall portion 63 for a pivotal hinged connection between the top wall and sidewall portion.

Fabric covering 96 extends over both the secured frame 52 and free frame 54 with the opposite side edge being folded back and stitched continuously at 104 (FIG. 10) to define another sleeve 106 through which the bottom crossbar 90 of free frame 54 extends. A strip 108 of Velcro-type fabric is sewn or otherwise secured to the underside of sleeve 106 along a substantial portion of the length thereof for detachable connection to the co-acting Velcro strip 86 on fabric sleeve 70 of the opposite sidewall portion 63 as shown on FIG. 5. Fabric covering 96 furthermore includes an elongated center fabric strip 110 (FIGS. 10 and 11) which is stitched continuously to the fabric covering at 112, 114, and 116 to define a pair of sleeves through which the top crossbars 88 of the top frames 52 and 54 extend.

Thus the top frames 52 and 54 are pivotally secured together. The extent to which the frames can be pivoted apart is limited by triangular top end walls 118 (FIG. 9) of netting material which are each sewn to a respective end edge of fabric covering 96 together with an associated pair of triangular end wall flaps 120 and 122 which can be rolled up and secured adjacent the end edge of fabric covering 96 by tie-strings 124. Upon spreading of the top frames 52 and 54 to the open position shown in FIG. 9, Velcro strip 108 on sleeve 106 (FIG. 5 and 10) is detachably engageable with Velcro strip 86 on the associated sidewall portion 63 for supporting the top 28 on the enclosure.

When an open topped enclosure is preferred, the Velcro strip 108 of top 28 is detached from the sidewall Velcro strip 86, whereupon the top frames 52 and 54 are pivotally collapsed together and pivoted as a unit about the top of the opposite sidewall portion 63 for placement against that sidewall portion as illustrated in FIG. 8. A short Velcro retention strip 126 (FIG. 10) in engageable with Velcro strip 108 to secure the top frames 52 and 54 together is their collapsed position.

To cushion the support surface for a child, a removable floor mat 128 (FIGS. 5 and 7) covers floor surface 26. The floor-mat 128 is preferably a nylon envelope containing a foam sheet insert 130 for padding.

Figure 12A:
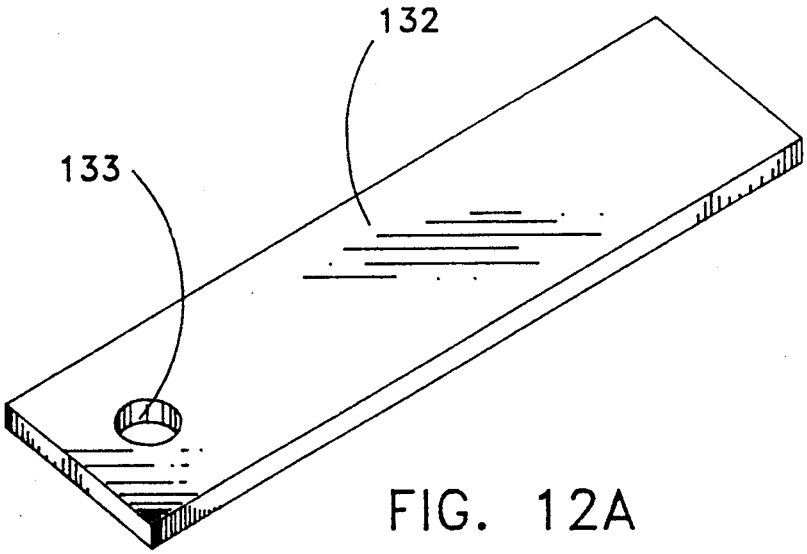
FIG. 12 A is a perspective view of a pivotal support brace for the enclosure.
Figure 12B:
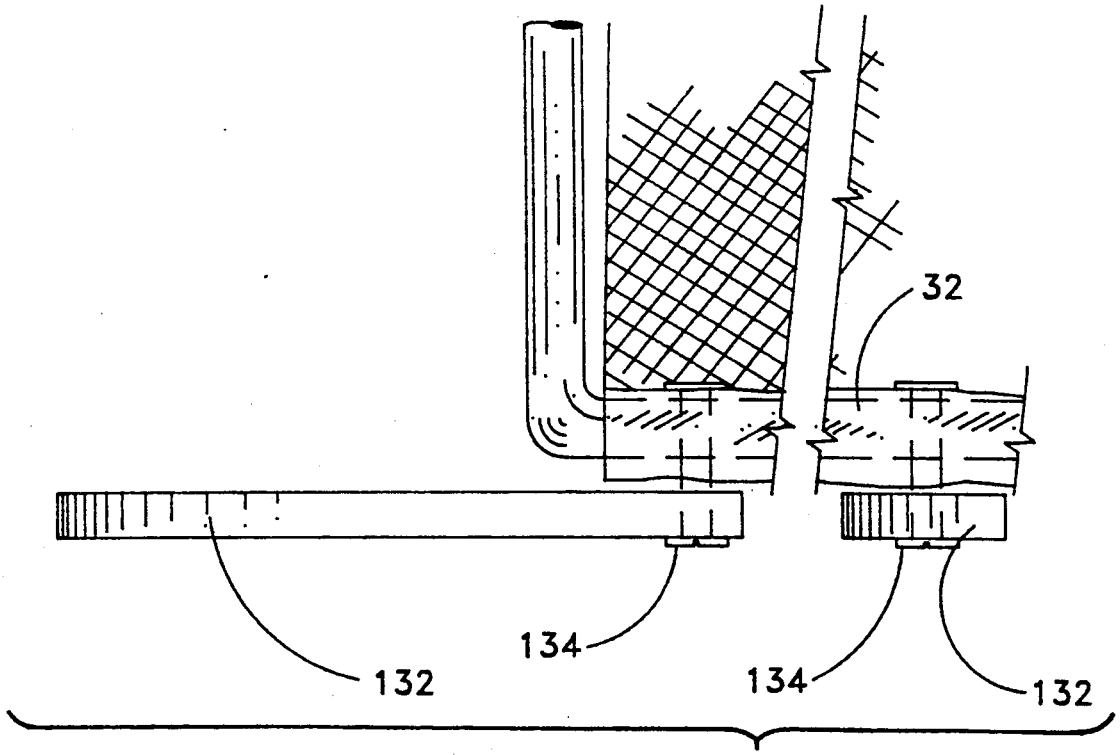

Due to the light weight of the assembled enclosure, pivotal foot supports 132 (FIGS. 1 and 12 A and 12 B) may be provided to stabilize the enclosure and resist movement due to wind and the like. Each foot support may comprise a generally rigid strip of aluminum or the like with a hole 133 in one end for a pivotal connection to a frame bottom crossbar 32 by vertical pivot fasteners 134 such as rivets, bolts or the like. The foot supports 132 are preferably spaced sufficiently apart so that both can be aligned with bottom crossbar 32 for minimal interference when the enclosure is collapsed.

Access to and from the enclosure may be facilitated by providing a zipper 136 through sidewall 20 as shown in FIG. 1. A zipper may be L-shaped, C-shaped, or of any other shape to define a flap which may be opened to allow entry through sidewall 20.

Whereas the protective play enclosure of the invention has been shown and described in connection with a preferred embodiment thereof, it is understood that many modifications, additions and substitutions may be made which are within the intended broad scope of the appended claims. For example, the various tubular members illustrated in section in FIGS. 5 and 10 may be enclosed within foam sleeves, as illustrated, both to prevent injury to a child and to cushion the contact between the tubes and fabric of the enclosure. Similar foam sleeves and fabric covers may be provided on the end braces 34 and 36. Whereas the various stitching in the patent drawings shows fabric layers slightly separated for clarity, it is understood that all such stitching sews the various fabric layers tightly together for a clean strong sewn connection.

The enclosure of the invention is safe for infants and toddlers, yet later can be used as a playhouse for older children. The various roll-up wall flaps and top could be custom printed to make the enclosure appear like a castle, cave, spaceship, teepee, or the like. It can be used with or without the top since the top can be easily displaced against one sidewall when not in use. Likewise, the flaps can be raised or lowered to regulate the amount of sunlight or wind entering the enclosure.

Erection and collapsing of the enclosure is accomplished quickly and easily by simply adjusting the first and second frame members 14 and 16 between their extended and collapsed positions, respectively. In the collapsed positions, both frame members lie parallel with floor 26 and the folded top 28 likewise lies parallel over the collapsed frame members to form a relatively small flat package for compact storage and transport. A shoulder strap may be added to facilitate carrying the enclosure in its collapsed position.

Thus there has been shown and described a protective play enclosure which accomplishes at least all of the stated objects.

I claim:

1. A protective play enclosure, comprising a frame including a first generally, rectangular frame member including top and bottom crossbars and a pair of end braces connected to and extended between respective ends of said top and bottom crossbars, a second generally rectangular frame member including top and bottom crossbars and a pair of end braces connected to and extended between respective ends of said top and bottom crossbars, and a generally rectangular flexible fabric floor having four side edges, said floor being connected to and extended between said bottom crossbars so that the width of said floor is substantially the width of the assembled enclosure, a flexible wall including two sidewalls and two end walls connected to the four side edges of said floor and adapted to extend upwardly therefrom to form collapsible walls for said enclosure, the end braces of said first and second frame members being crossed and the top crossbar of the first frame member being connected to the same sidewall that is connected to the bottom crossbar of the second frame member and the top crossbar of the second frame member being connected to the same sidewall that is connected to the bottom crossbar of the first frame member, said frame end braces being extendible from a collapsed condition not substantially longer than the width of said floor to an extended condition longer than the width of said floor, means for releasably securing said frame crossbars in the extended condition thereof whereby said walls are supported in upright relation upon engagement of said bottom crossbars on a support surface, and a top having one side connected to the top crossbar of one frame member and an opposite side releasably connectable to the top crossbar of the other frame member for displacement of said top to afford an open topped enclosure at times.

2. The enclosure of claim 1 wherein the length of the sides of said top substantially correspond to the length of said frame member top crossbars and the width of said top being longer than the width of each end wall, said top including end braces for generally arched support of said top over said enclosure upon connection of said opposite side of the top to the top crossbar of said other frame member.

3. The enclosure of claim 2 wherein said top includes a pair of rectangular frames, a fabric covering across both frames and said frames being pivotally connected for movement between open and closed positions.

4. The enclosure of claim 3 wherein said rectangular frames are arranged in generally stacked relation in the closed position of said top.

5. The enclosure of claim 4 wherein said top, in the closed position thereof, is pivotally moveable to a position adjacent one sidewall.

6. The enclosure of claim 2 further comprising co-acting means on said opposite side of the top and top crossbar of the other frame member for releasably connecting said opposite side of the top to the top crossbar of said other frame member.

7. The enclosure of claim 6 wherein said co-acting means comprises a pair of strips of hook and loop type fasteners.

8. The enclosure of claim 2 wherein said top further comprises opposite end edges and opposite end walls each suspended from one end edge for closing the opening between said end edge and end wall.

9. The enclosure of claim 8 wherein each wall of the top has a bottom edge and means for releasably securing said bottom edge to the adjacent end wall of said flexible wall.

10. The enclosure of claim 9 further comprising fabric panels suspended across said top end walls, said fabric panels being displaceable from said end wall and means for releasably securing said panels in displaced positions.

11. The enclosure of claim 1 wherein said end braces are telescopically extendable and retractable.

12. The enclosure of claim 11 wherein each frame member comprises a pair of U-shaped frame sections, each section including one crossbar and a portion of each end brace.

13. The enclosure of claim 12 wherein said frame sections are formed of aluminum tubing.

14. The enclosure of claim 1 herein two opposite side edges of said fabric floor are formed into sleeves through which said bottom crossbars of said first and second frame numbers are extended.

15. The enclosure of claim 1 wherein a substantial portion of said flexible wall comprises a netting material.

16. The enclosure of claim 15 wherein said flexible wall includes an upper edge defining a substantially continuous fabric collar.

17. The enclosure of claim 16 wherein said fabric collar defines a pair of opposite sleeves through which said top crossbars of the first and second frame members extend.

18. The enclosure of claim 15 including four fabric panels suspended from upper portions of the sidewalls and end walls for removably and substantially covering said sidewalls and end walls at times and means for releasably securing said fabric panels in raised positions adjacent said upper portions of said walls.

19. The enclosure of claim 1 further comprising a brace means connected to said bottom crossbars and extended outwardly therefrom.

20. The enclosure of claim 19 wherein brace means are connected to said bottom crossbars for pivotal movement about respective upright axes.

* * * * *